US010014128B2

(12) United States Patent
Kannan et al.

(10) Patent No.: US 10,014,128 B2
(45) Date of Patent: Jul. 3, 2018

(54) PORTABLE POWER TOOL WITH TRIGGER SWITCH, TRIGGER RELEASE AND LOCK-ON MECHANISM COMBINATION

(71) Applicants: Robert Bosch Tool Corporation, Broadview, IL (US); Robert Bosch GmbH, Stuttgart (DE)

(72) Inventors: Selvakumar Kannan, Sungai Petani (MY); James Stevens, Oak Park, IL (US); Vincent Hong, Bukit Mertajam (MY); Zaal-Azhar Alias, Sungai Petani (MY)

(73) Assignees: Robert Bosch Tool Corporation, Broadview, IL (US); Robert Bosch GmbH, Stuttgart (DE)

( * ) Notice: Subject to any disclaimer, the term of this patent is extended or adjusted under 35 U.S.C. 154(b) by 756 days.

(21) Appl. No.: 14/565,496

(22) Filed: Dec. 10, 2014

(65) Prior Publication Data

US 2015/0170848 A1 Jun. 18, 2015

Related U.S. Application Data

(60) Provisional application No. 61/917,017, filed on Dec. 17, 2013.

(51) Int. Cl.

| | |
|---|---|
| ***H01H 9/22*** | (2006.01) |
| ***B25F 5/02*** | (2006.01) |
| ***H01H 3/20*** | (2006.01) |
| ***H01H 9/06*** | (2006.01) |

(52) U.S. Cl.

CPC ..... *H01H 9/22* (2013.01); *B25F 5/02* (2013.01); *H01H 3/20* (2013.01); *H01H 9/06* (2013.01); *H01H 2221/068* (2013.01); *H01H 2231/048* (2013.01); *H01H 2300/024* (2013.01)

(58) Field of Classification Search

CPC .. H01H 9/22; H01H 3/20; H01H 9/06; H01H 2300/024; H01H 2221/068; H01H 2231/048; B25F 5/02

See application file for complete search history.

(56) References Cited

U.S. PATENT DOCUMENTS

| | | | | | |
|---|---|---|---|---|---|
| 2,525,839 | A * | 10/1950 | Sparklin | B23B 45/008 | 173/170 |
| 3,194,084 | A * | 7/1965 | Filander | H01H 13/08 | 200/293.1 |
| 3,217,559 | A * | 11/1965 | Elligson | B23B 45/001 | 200/293.1 |
| 3,662,136 | A * | 5/1972 | Bienwald | H01H 13/62 | 200/318 |
| 3,746,813 | A * | 7/1973 | Brown | H01H 13/62 | 173/170 |
| 3,780,246 | A * | 12/1973 | Beckering | H01H 9/06 | 200/322 |

(Continued)

*Primary Examiner* — Hemant M Desai
*Assistant Examiner* — Eduardo R Ferrero
(74) *Attorney, Agent, or Firm* — Maginot, Moore & Beck LLP

(57) ABSTRACT

A power tool includes a housing, a motor enclosed within the housing, and a work element configured to be driven by the motor. A trigger is movably secured to the housing for controlling power to the motor. A locking assembly is provided that includes a lock-OFF mechanism configured to lock the trigger in the OFF position and a lock-ON mechanism configured to lock the trigger in the ON position.

2 Claims, 8 Drawing Sheets

(56) References Cited

U.S. PATENT DOCUMENTS 3,781,579 A * 12/1973 Rosenthal, Jr. ..... H01H 13/08 200/318.1
3,829,645 A * 8/1974 Piber ..... H01H 9/06 200/43.17
3,847,233 A * 11/1974 Glover ..... A01G 3/053 173/170
3,854,020 A * 12/1974 Glover ..... H01H 9/06 200/293.1
3,873,796 A * 3/1975 Worobec, Jr. ..... H01H 3/20 200/320
3,881,081 A * 4/1975 Schilling ..... F16P 3/00 200/318.1
3,971,906 A * 7/1976 Sahrbacker ..... B25F 5/02 200/43.17
4,054,766 A * 10/1977 Kramer ..... H01H 9/06 200/343
4,180,716 A * 12/1979 Suzuki ..... H01H 9/06 200/320
4,219,714 A * 8/1980 Suzuki ..... H01H 13/62 200/43.17
4,449,062 A * 5/1984 Wilson ..... A01D 34/828 200/83 Z
4,879,438 A * 11/1989 Winchester ..... H01H 9/06 200/505
5,401,928 A * 3/1995 Kelley ..... H01H 9/06 200/510
5,577,600 A * 11/1996 Schoene ..... H01H 3/20 200/321
5,638,945 A * 6/1997 Fukinuki ..... H01H 3/20 200/318
5,969,312 A * 10/1999 Svetlik ..... H01H 3/20 200/318
6,057,518 A * 5/2000 Bascom ..... H01H 3/20 200/321
6,091,035 A * 7/2000 Campbell ..... H01H 3/20 200/321
6,274,828 B1 * 8/2001 Chu ..... H01H 13/08 200/321
6,812,425 B1 * 11/2004 Wong ..... H01H 9/06 200/321
8,198,560 B2 * 6/2012 Kimata ..... H01H 3/20 200/318.1
8,827,004 B2 * 9/2014 Hosokawa ..... B25F 5/02 173/170
2002/0153237 A1 * 10/2002 Covell ..... H01H 9/06 200/321
2004/0049926 A1 * 3/2004 Miklosz ..... B27B 9/00 30/391
2004/0074752 A1 * 4/2004 Svetlik ..... H01H 3/20 200/321
2006/0060364 A1 * 3/2006 Lam ..... H01H 3/20 173/2
2006/0185865 A1 * 8/2006 Jung ..... B25D 16/006 173/48
2007/0012554 A1 * 1/2007 Lui ..... H01H 1/20 200/341
2007/0144310 A1 * 6/2007 Pozgay ..... B25B 21/00 81/57.26
2008/0093203 A1 * 4/2008 Dick ..... B25C 1/008 200/43.17
2009/0236387 A1 * 9/2009 Simonelli ..... B25C 1/008 227/8
2010/0018734 A1 * 1/2010 Frauhammer ..... B25D 16/006 173/171
2011/0005905 A1 * 1/2011 Fukinuki ..... B25F 5/02 200/43.18
2011/0057014 A1 * 3/2011 Yang ..... B25C 1/008 227/8
2011/0272172 A1 * 11/2011 Lau ..... B25F 3/00 173/170
2013/0161161 A1 * 6/2013 Parrinello ..... B25F 5/00 200/43.17
2013/0206561 A1 * 8/2013 Kong ..... H01H 5/04 200/341
2013/0277189 A1 * 10/2013 Yuan ..... H01H 3/20 200/332
2014/0131058 A1 * 5/2014 Keith ..... B23Q 11/0078 173/18

* cited by examiner

PORTABLE POWER TOOL WITH TRIGGER SWITCH, TRIGGER RELEASE AND LOCK-ON MECHANISM COMBINATION

CROSS-REFERENCE TO RELATED APPLICATIONS

This application claims priority to U.S. Provisional Application Ser. No. 61/917,017 entitled "PORTABLE POWER TOOL WITH TRIGGER SWITCH, TRIGGER RELEASE AND LOCK-ON MECHANISM COMBINATION" by Kannan et al., filed Dec. 17, 2013, the disclosure of which is hereby incorporated herein by reference in its entirety.

TECHNICAL FIELD

This disclosure relates generally to portable power tools, and in particular, to trigger switches and switch locking mechanisms for portable power tools.

BACKGROUND

In general, a portable power tool, such as a planer, jigsaw, circular saw, drill driver, and the like, includes a trigger that is movable by an operator of the tool between an ON position and an OFF position to control power to the tool. Some power tools are also provided with a trigger release mechanism which is capable of keeping the trigger in the OFF position. The trigger release mechanism typically comprises a button or switch that can be moved to a position at which movement of the trigger from the OFF position to the ON position is blocked or otherwise prevented. The trigger release mechanism must be moved to a non-blocking position to allow the trigger to be moved to the ON position so the tool can be operated.

Some other power tools are provides with a trigger lock-on mechanism which is capable of keeping the trigger in the ON position. The trigger lock-on mechanism typically comprises a button or switch that can be moved to a position at which movement of the trigger from the ON position to the OFF position is blocked or otherwise prevented. To allow the trigger to be moved to the OFF position so the tool can be turned off, the trigger much be pressed so that the lock-on mechanism can be moved to a non-blocking position.

Until now, there are no known power tools have both a trigger release mechanism and a trigger lock-on mechanism.

DRAWINGS

DESCRIPTION

Figure 1:
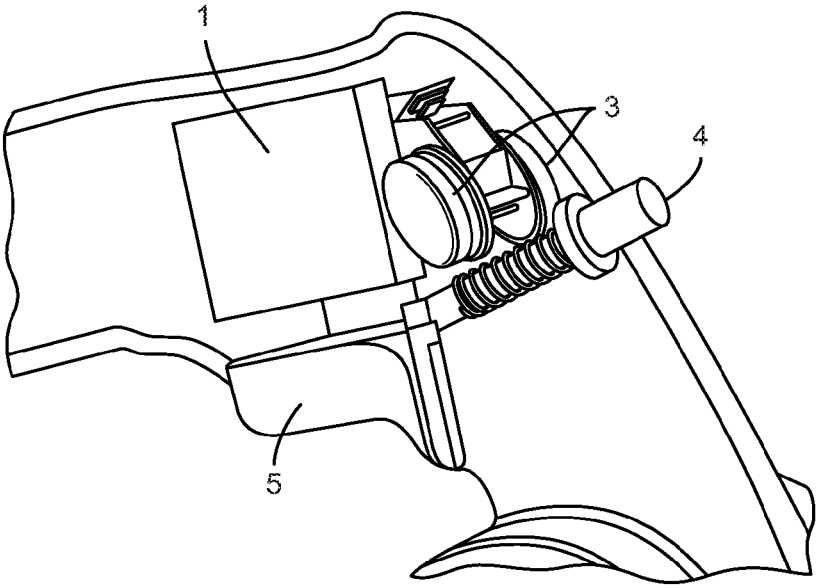
FIG. 1 depicts a perspective view of a portion of the handle of a portable power tool equipped with an embodiment of a trigger and release mechanism, and lock-on mechanism with the handle partially transparent so that the trigger, release, and lock-ON mechanisms can be seen in the handle.

For the purposes of promoting an understanding of the principles of the disclosure, reference will now be made to the embodiments illustrated in the drawings and described in the following written specification. It is understood that no limitation to the scope of the disclosure is thereby intended. It is further understood that the present disclosure includes any alterations and modifications to the illustrated embodiments and includes further applications of the principles of the disclosure as would normally occur to a person of ordinary skill in the art to which this disclosure pertains.

This disclosure is directed to a trigger assemblies for power tools having a locking mechanism configured to selectively lock the trigger in both the OFF position, e.g., OFF mode, and the ON position, e.g., ON mode. In the lock OFF mode, the mechanism locks the switch or trigger of the power tool in the OFF position. This can be used when the tool is not being used to prevent inadvertent actuation of the tool, e.g., when the tool is being carried in the hand of an operator and not in use. In the lock-ON mode, the mechanism locks the trigger in the ON position, which can be used to allow continuous use of the tool without requiring the user to maintain pressure on the trigger. The mechanism may be configured to provide an unlocked mode in which the trigger operates normally (with continuous pressure on the trigger) to control power to the tool. The switch and mechanism may also be configured so that the power tool can be switched out of the lock-ON mode to the unlocked mode by pressing the trigger.

According to the embodiments described herein, a trigger assembly for a power tool and/or a power tool having a trigger assembly is provided. The power tool includes a housing, a motor enclosed within the housing, and a work element configured to be driven by the motor. The trigger assembly includes a trigger movably secured to the housing that is configured to be moved to an ON position at which power is supplied to the motor and to an OFF position at which power is disconnected from the motor. The trigger assembly also includes a locking assembly that is supported by the housing and includes a lock-OFF mechanism configured to lock the trigger in the OFF position and a lock-ON mechanism configured to lock the trigger in the ON position. When the trigger is not locked in the OFF position or the ON position, the trigger is in an unlocked mode in which the trigger is allowed to move between the OFF and ON positions.

The trigger may be configured to move between an extended position and a depressed position with the extended position corresponding to the OFF position and the depressed position corresponding to the ON position. The lock-OFF mechanism is configured to releasably lock the trigger in the extended position, and the lock-ON mechanism is configured to releasably lock the trigger in the depressed position.

The lock-OFF mechanism may be movably supported by the housing for movement between a blocking position and a non-blocking position with respect to the trigger. The lock-OFF mechanism includes a lock-OFF structure such that, when the trigger is in the OFF position and the lock-OFF mechanism is in the non-blocking position, the lock-OFF structure is positioned to allow the trigger to move between the OFF and ON positions, and, when the trigger is in the OFF position and the lock-OFF mechanism is in the blocking position, the lock-OFF structure is positioned to block movement of the trigger from the OFF position. The lock-OFF mechanism may include at least one actuator that is accessible from an exterior of the housing and configured to move the lock-OFF mechanism between the blocking position and the non-blocking position. In one embodiment, the lock-OFF mechanism is laterally slidable with respect to the housing and the trigger between the blocking and non-blocking positions. In this embodiment, the at least one actuator may include a first actuator located at a first lateral end of the locking mechanism and a second actuator located at a second lateral end of the locking mechanism.

The lock-ON mechanism is movably supported by the housing for movement between a blocking position and a non-blocking position with respect to the trigger. The lock-ON mechanism may include a lock-ON structure such that, when the trigger is in the ON position and the lock-ON mechanism is in the non-blocking position, the lock-ON structure is positioned to allow the trigger to move between the OFF and ON positions, and, when the trigger is in the ON position and the lock-ON mechanism is in the blocking position, the lock-ON structure is positioned to block movement of the trigger from the ON position. The lock-ON mechanism may include a push button that is accessible from an exterior of the housing and configured to move the lock-ON mechanism from the non-blocking position to the blocking position.

In one embodiment, the lock-ON mechanism comprises a pin that is supported for axial movement between the blocking and non-blocking positions. The pin has an inner end arranged facing the trigger and an outer end that is accessible from an exterior of the housing with the inner end including the locking structure and the outer end including the push button. The pin may be biased toward the non-blocking position. In one embodiment, the trigger includes a plurality of walls that define a recess in which the inner end of the pin is received when the pin is moved to the blocking position. The plurality of walls may include a ramped surface that is configured to move into contact with the inner end of the pin when the trigger is moved from the ON position toward the OFF position. The contact between the ramped wall and the inner end of the pin is configured to cause the pin to move from the blocking position to the non-blocking position.

In another embodiment, a power tool includes a housing, a motor enclosed within the housing, and a work element configured to be driven by the motor. A trigger assembly includes a trigger movably secured to the housing and configured to be moved to an ON position at which power is supplied to the motor and to an OFF position at which power is disconnected from the motor. The trigger assembly also includes a locking assembly supported by the housing and including a lock-OFF mechanism configured to lock the trigger in the OFF position and a lock-ON mechanism configured to lock the trigger in the ON position.

In this embodiment, the locking assembly includes a locking mechanism that is movably supported by the housing for movement between a non-blocking position and a blocking position with respect to the trigger. The trigger includes a first blocking structure that defines a first gap corresponding to a lock-OFF position and a second gap corresponding to a lock-ON position. The locking mechanism includes a second blocking structure that is configured to be located in the first gap when the trigger is in the OFF position and the locking mechanism is in the blocking position, and to be located in the second gap when the trigger is in the ON position and the locking mechanism is in the blocking position. When the second blocking structure is in the first gap, the second blocking structure blocks movement of the trigger from the OFF position, and, when the second blocking structure is in the second gap, the second blocking structure blocks movement of the trigger from the ON position. The second blocking structure is spaced apart from the first gap and the second gap when the locking mechanism is in the first position. The locking mechanism may include at least one actuator that is accessible from an exterior of the housing and configured to move the locking mechanism between the blocking position and the non-blocking position. The locking mechanism may be laterally slidable with respect to the housing and the trigger between the blocking and non-blocking positions in which case the that at least one actuator may include a first actuator located at a first lateral end of the locking mechanism and a second actuator located at a second lateral end of the locking mechanism.

Figure 2:
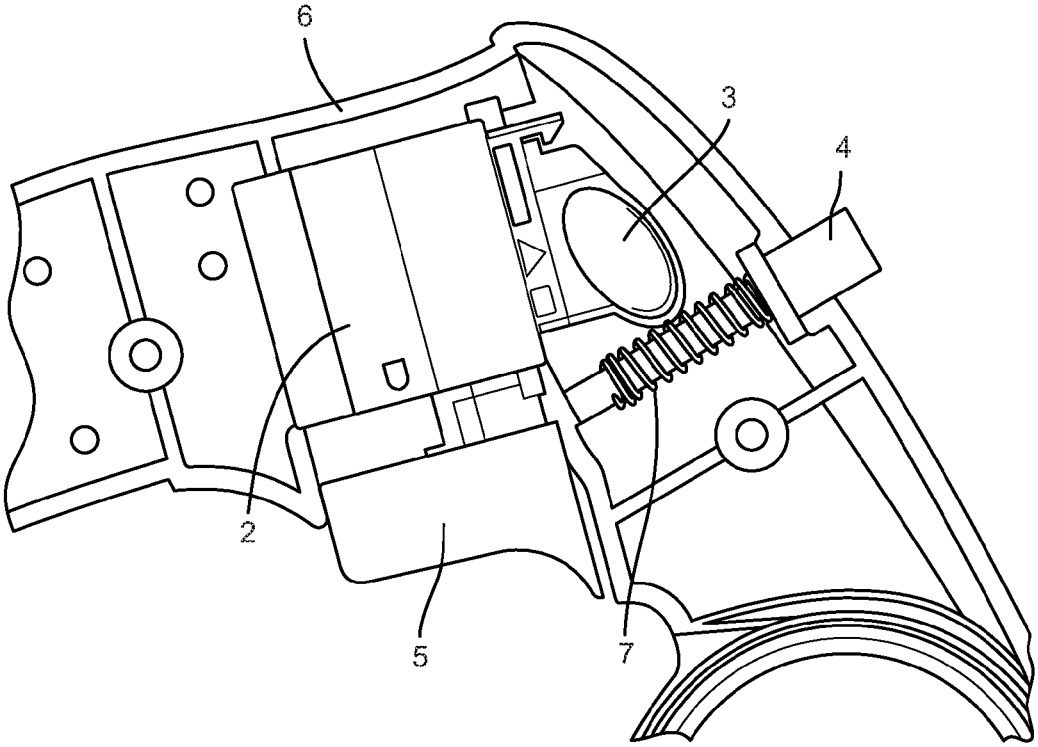
FIG. 2 depicts a side view of the trigger, release, and lock-on mechanisms of FIG. 1 with a portion of the outer handle removed.

FIGS. 1 and 2 depict a handle of a portable power tool such as a planer, jigsaw, circular saw, drill driver, and the like, in which an embodiment of a switch and locking mechanism in accordance with the present disclosure is incorporated. The switch and locking mechanism includes a trigger 5, a switch 1, a release mechanism 3, and a lock-ON pin 4. The switch 1 is operably coupled to control power to the motor (not shown) of the tool based on a position of the trigger 5. The trigger 5 is configured to move between an extended position, or OFF position, and a depressed position, or ON position.

Figure 3A:
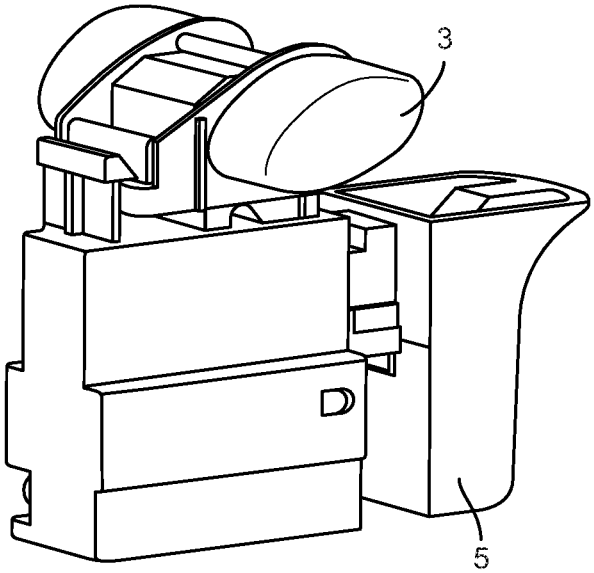
FIG. 3A is a more detailed view of the components of the trigger and release button of the trigger, release and locking mechanisms of FIGS. 1 and 2 in a locked-off position.
Figure 3B:
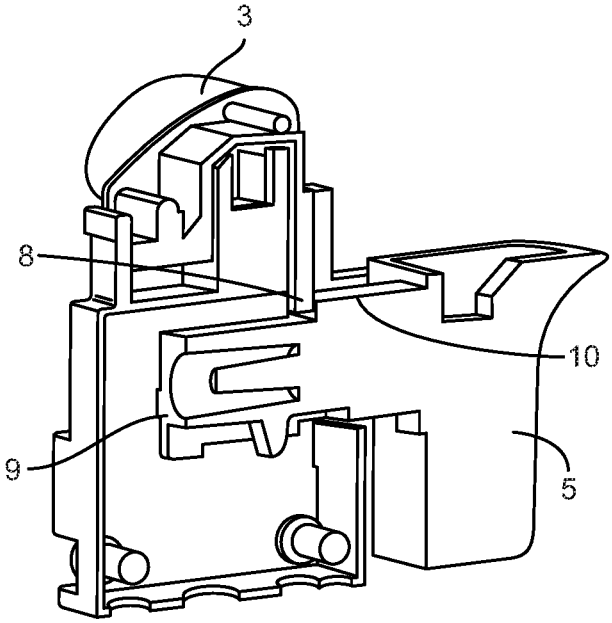
FIG. 3B is a cross-sectional view of the components of the trigger and release button of FIG. 3A.

Referring to FIGS. 3A, 3B, and 5A-5C, the release button 3 is configured to slide laterally with respect to the switch 1 and the trigger 5 between a blocking position and a non-blocking position. In the blocking position, such as depicted in FIG. 3B, the release button 3 is positioned to block movement of the trigger 5 toward the switch 1 and into the depressed or ON position so that the trigger 5 is in a locked-off position. The trigger 5 includes a post 9 that extends past the lock button and into the switch 1.

Figure 5A:
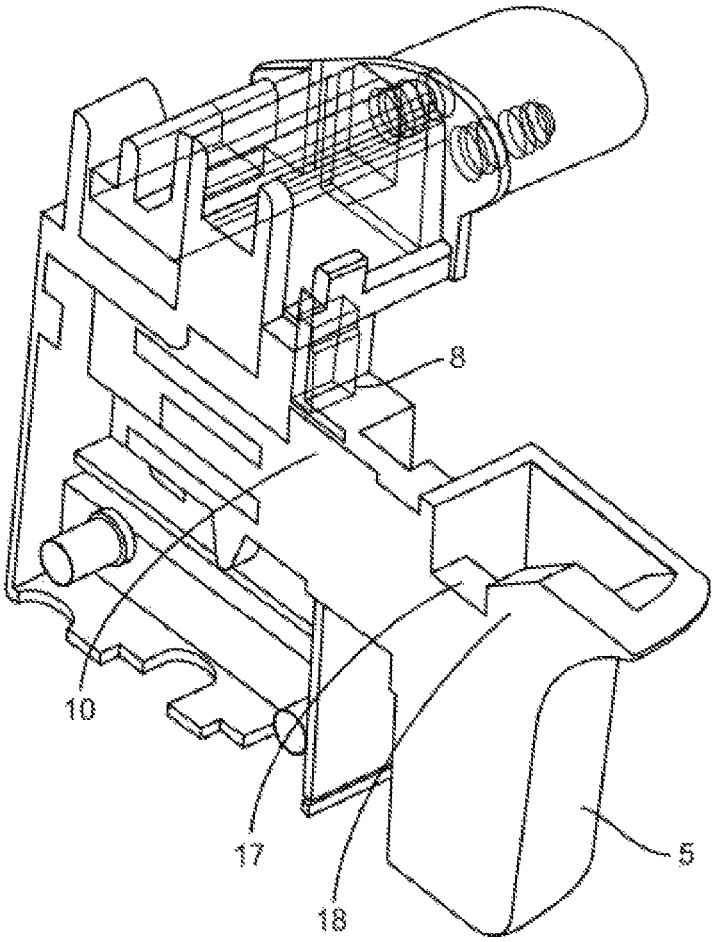
FIG. 5A is a perspective view of the cross-section depicted in FIG. 3B in an unlocked position showing the recess and the ramp on the trigger.
Figure 5B:
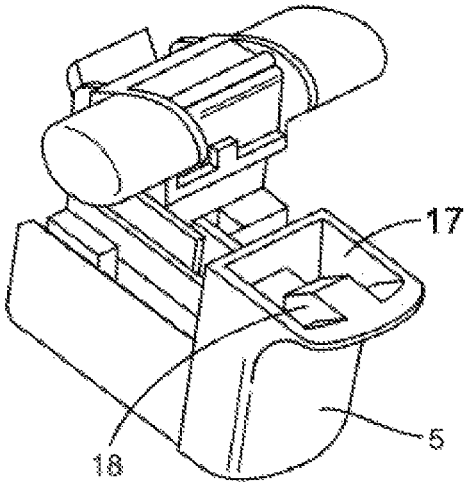
FIG. 5B is a perspective view of the components of FIG. 3A showing the recess and the ramp on the trigger.
Figure 5C:
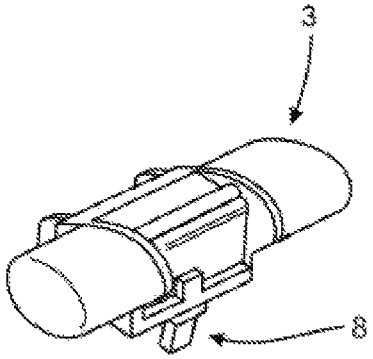
FIG. 5C is a perspective view of the release button assembly of FIG. 5B removed from the trigger.

The release mechanism's 3 blocking functionality is provided by detents or pins provided on the trigger and/or release button. A detent structure 10, such as a pin, rim, ledge, or similar type of structure, extends from the post 9 toward the release button 3. The release button 3 includes at least one blocking pin 8 that extends from the release button 3 toward the post 9 of the trigger 5. The blocking pin 8 extends from the release button 3 to a position where the path of movement of the blocking pin 8 intersects the path of movement of the trigger detent 10. When the release button 3 is in a blocking position, as depicted in FIG. 3B, the blocking pin 8 is in the path of movement of the detent 10 and therefore is positioned to block movement of the trigger 5 toward the switch 1. As depicted in FIG. 5B, the release button 3 is configured to be pushed laterally by the operator to a non-blocking position. In the non-blocking position, the blocking pin 9 is moved out of the path of movement of the trigger detent 10 so that the trigger 5 is free to be moved between the ON position and the OFF position as depicted in FIG. 5A.

Figure 4A:
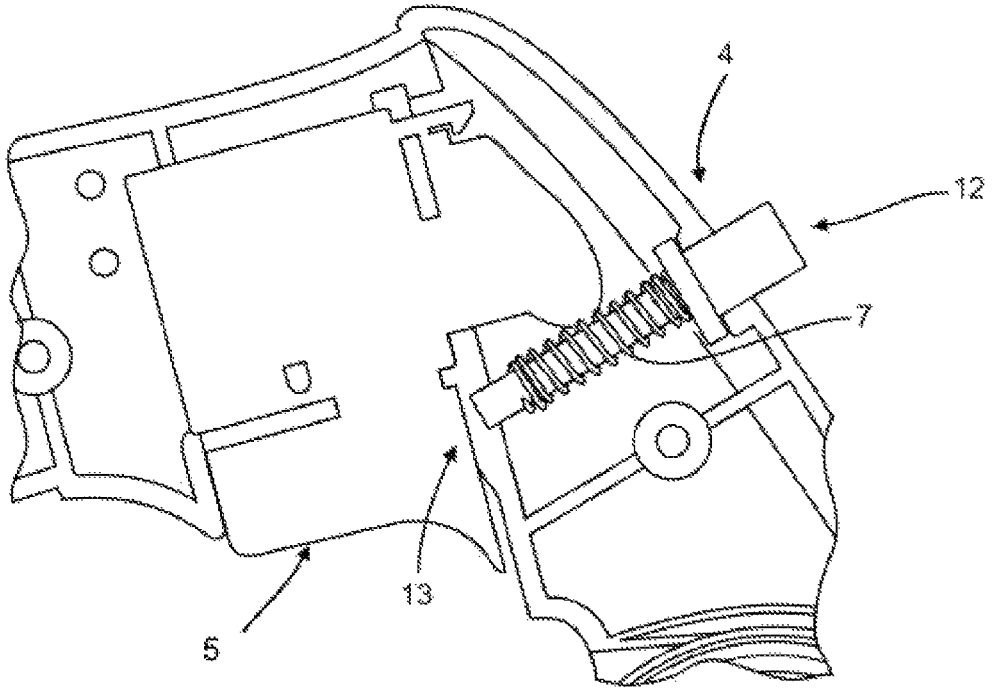
FIG. 4A is a partial view of the components depicted in FIG. 2 with the lock-ON pin delineated and in an unlocked position.
Figure 4B:
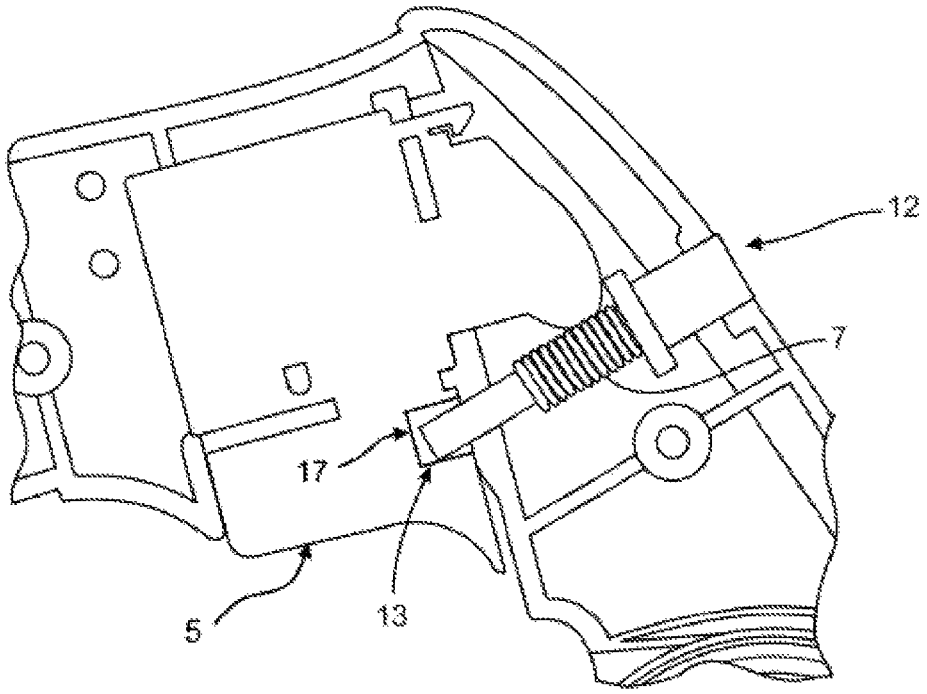
FIG. 4B is a partial view of the components depicted in FIG. 2 with the lock-ON mechanism in a locked-on position.

The lock-on mechanism of FIGS. 1-3 is configured to releasably lock the trigger 5 in the ON position. Referring to FIGS. 4A and 4B, the lock-on mechanism includes a push button end 12 and a lock pin end 13. The push button end 12 is located exterior to the handle where it can be easily pressed by the operator. The lock pin end 13 extends to a position near the trigger 5. The lock-on mechanism is configured to be moved between an unlocked position (FIG. 4A) and a locked-on position (FIG. 4B). In the unlocked position, the lock pin end 13 is spaced apart from the trigger 5 as seen in FIG. 4A.

In the locked-on position as depicted in FIG. 4B, the lock pin end 13 is moved into the path of movement of the trigger 5 and is received in a recess 17 (FIG. 5A), or cutout, in the trigger 5. The recess 17 in the trigger is positioned to receive the lock pin end when the trigger is in the ON position. When the trigger 5 is moved to the ON position, an operator can press the push button end 12 of the lock-on mechanism 4 to move the lock pin end 13 into engagement with the recess 17 in the trigger 5. So long as the lock pin end 13 is located within the recess 17, the lock pin end 13 can block movement of the trigger 5 toward the OFF position, thus providing a lock-ON mode for the tool.

The lock-on mechanism 4 is biased toward the unlocked position (FIG. 4A) by a spring 7. When in the locked-on position (FIG. 4B), the lock pin end 13 can be retained in the recess 17 by frictional engagement with the walls of the recess 17. As can be seen in FIGS. 5A and 5B, the front wall of the recess 17 includes an angled protrusion 18 that forms a ramp to allow the trigger 5 to be used to disengage the lock pin end 13 from the recess 17. The operator can press the trigger 5 to move the ramped surface 18 of the trigger 5 toward the lock pin end 13 which nudges the lock pin end 13 out of the recess 17 so that the spring 7 can return the lock pin to the unlocked position.

Figure 6A:
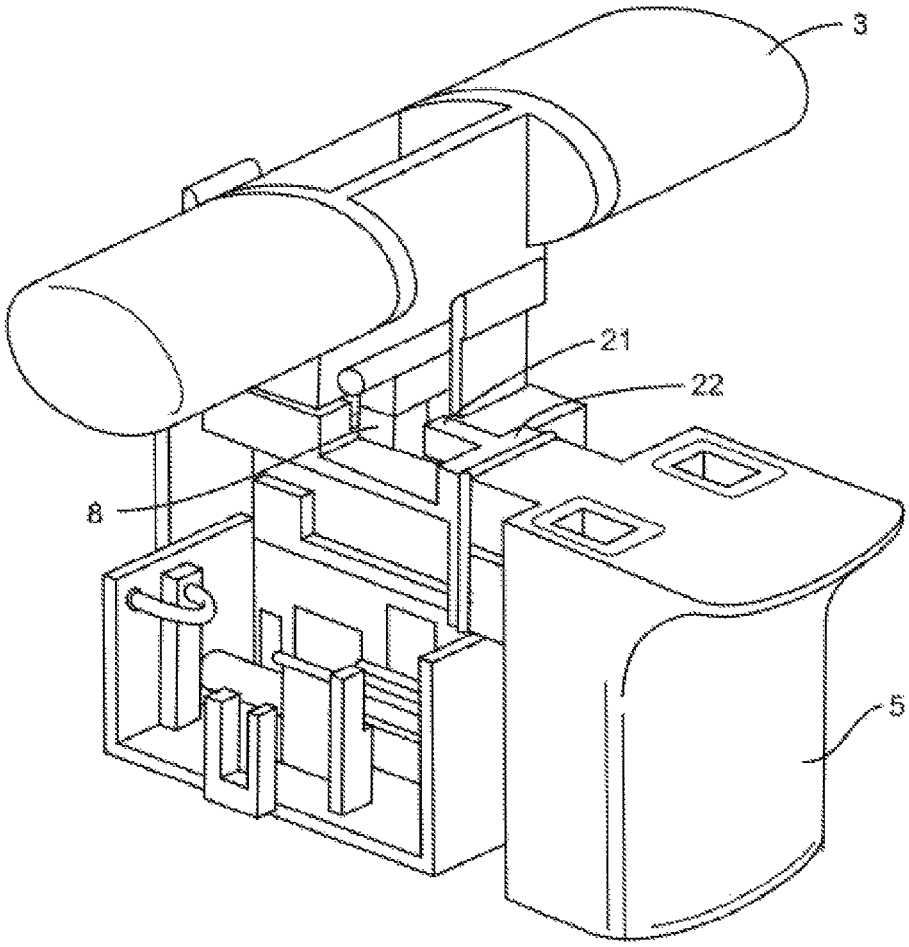
FIG. 6A is a perspective view of another embodiment of a trigger, release, and lock-on mechanism for use with a power tool in a locked-off position.
Figure 6B:
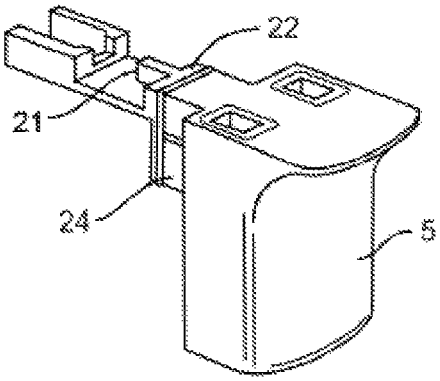
FIG. 6B is a perspective view of the trigger of FIG. 6A.
Figure 6C:
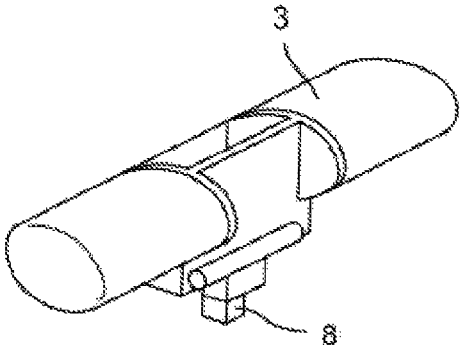
FIG. 6C is a perspective view of the release/lock button assembly of FIG. 6A.

FIGS. 6A-6C depict a second embodiment of trigger, release, and lock-on assembly that can be used as an alternative to the embodiment of FIGS. 1-5 to enable a locked-ON mode for the trigger. The embodiment of FIGS. 6A-6C includes a trigger 5 and a release/lock button 3. The trigger 5 is provided with a trigger pin/detent 21, and the release/lock button 3 includes a lock pin 8 that extends downwardly from the release/lock button 20 to a position where the path of movement of the lock pin 8 intersects the path of movement of the trigger pin 21, similar to the embodiment of FIGS. 1-5. When the lock button 3 is in a blocking position, as depicted in FIG. 6A, the lock pin 8 is in the path of movement of the trigger pin 21 and therefore is positioned to block movement of the trigger 5 toward the switch 1 and the ON position.

When the release/lock button 3 is pushed laterally, the lock pin 8 is moved out of the path of movement of the trigger pin 21 to a non-blocking position so the trigger 5 can be moved toward the ON position. When the trigger 5 is moved from the OFF position toward the ON position with the release/lock button 3 in a non-blocking position, the trigger pin/detent 21 is moved alongside the lock pin 8 and prevents the release/lock button 3 from returning to the blocking position.

The locked-on functionality is provided by interaction between the lock pin 8 on the release/lock button 3 and a locking position provided on the trigger 5. Referring to FIGS. 6A and 6B, the trigger pin/detent 21 comprises a narrow blocking wall portion that projects rearwardly from a wider base portion 22. The base portion 22 of the trigger pin/detent 21 extends laterally for a distance on each side of the narrow wall 21. The trigger base portion 22 in turn is positioned on the rear side of a narrow intermediate projecting portion that extends rearwardly from the trigger 5. The trigger base portion 22 extends laterally slightly beyond the side surfaces of the intermediate portion to form a recess or groove 24 for receiving and retaining the lock pin 8 of the release/lock button 3 to lock the trigger in the ON position.

To place the trigger 5 in the locked-ON position, the release/lock button 3 is pushed farther laterally from the non-blocking position to provide clearance for the lock pin 8 to move past the base portion 22 of the trigger pin/detent and be received in the locking groove 24 as the trigger 5 is pressed toward the ON position. The wide base portion 22 forms a rim or lip that can retain the lock pin 8 in the locking groove.

Figure 7A:
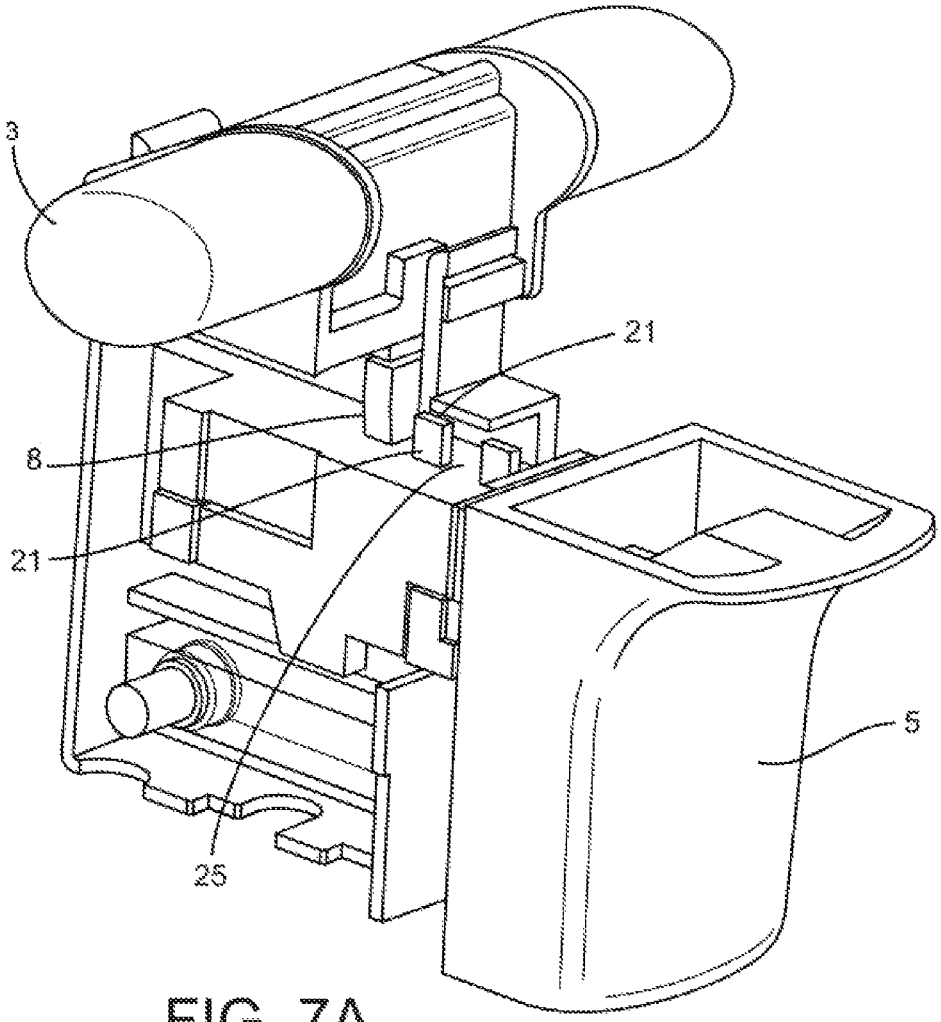
FIG. 7A is a perspective view of yet another embodiment of a trigger, release, and lock-on mechanism for use with a power tool in an locked-off position.
Figure 7B:
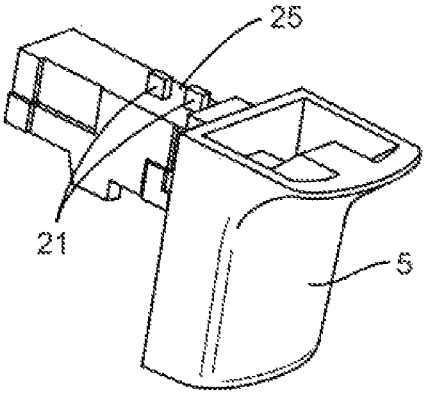
FIG. 7B is a perspective view of the trigger of FIG. 7A.
Figure 7C:
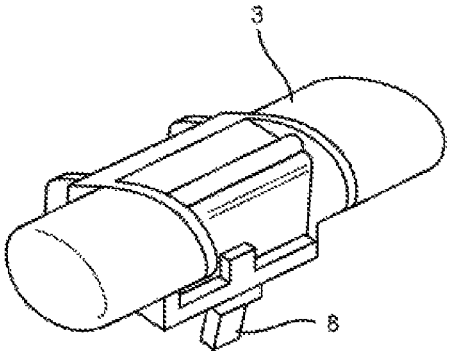
FIG. 7C is a perspective view of the release/lock button assembly of FIG. 7A.

FIGS. 7A-7C, 8 and 9 depict another embodiment of a trigger, release, and lock-on assembly that can be used as an alternative to the embodiments of FIGS. 1-6 to enable a locked-ON mode for the trigger. In this embodiment, the trigger 5 includes a trigger pin/detent 21, and the release/lock button 3 includes a lock pin 8 that extends downwardly from the release/lock button to a position where the path of movement of the lock pin 8 intersects the path of movement of the trigger pin/detent 21. When the lock button 3 is in a blocking position, as depicted in FIG. 7A, the lock pin 8 is in the path of movement of the trigger pin 21 and therefore is positioned to block movement of the trigger 5 toward the switch and the ON position.

Figure 8:
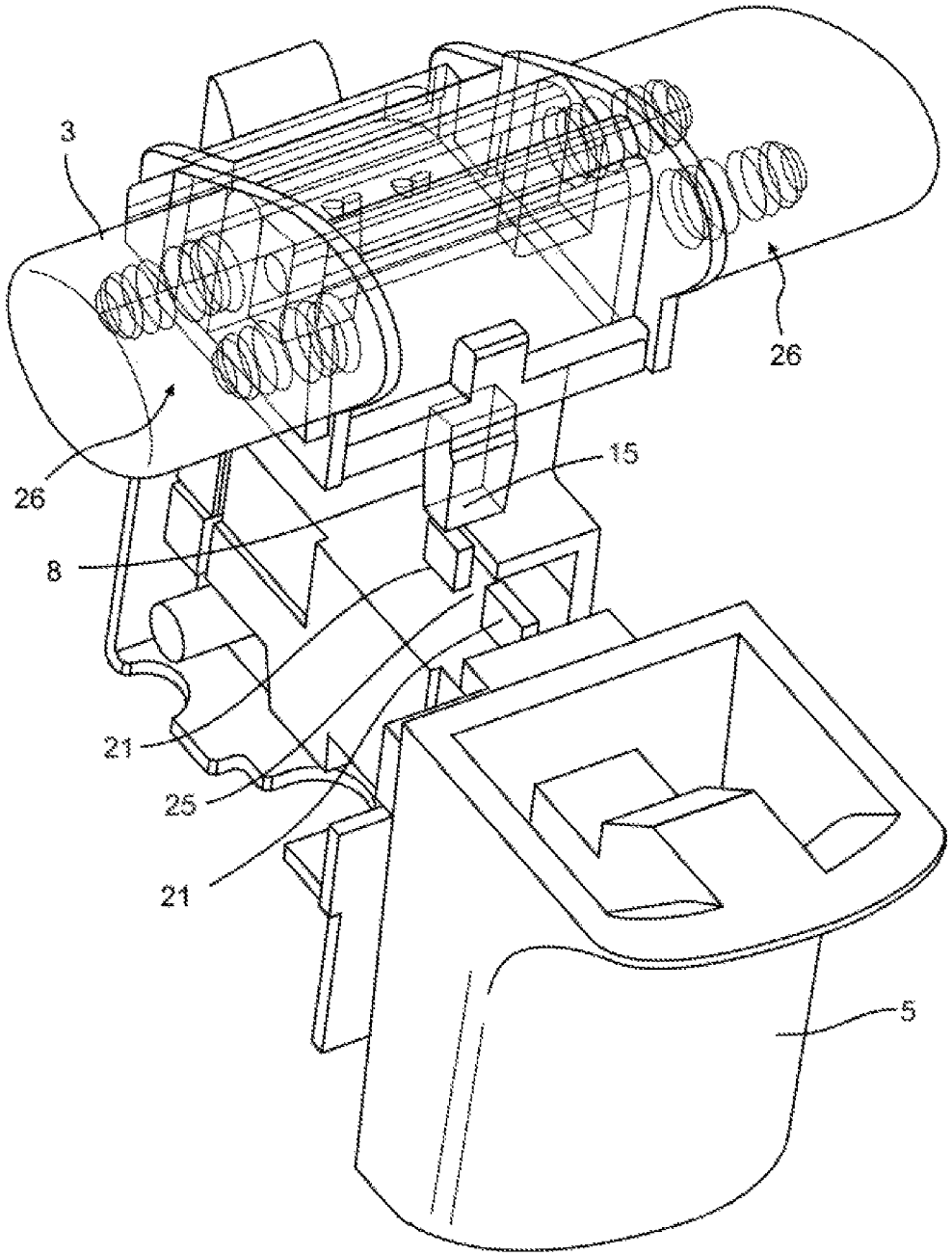
FIG. 8 is perspective view of the assembly of FIG. 7A in an unlocked position a detailed view of the second embodiment of the trigger and locking button showing the detents or pins on the trigger and locking button in an unlocked condition.
Figure 9:
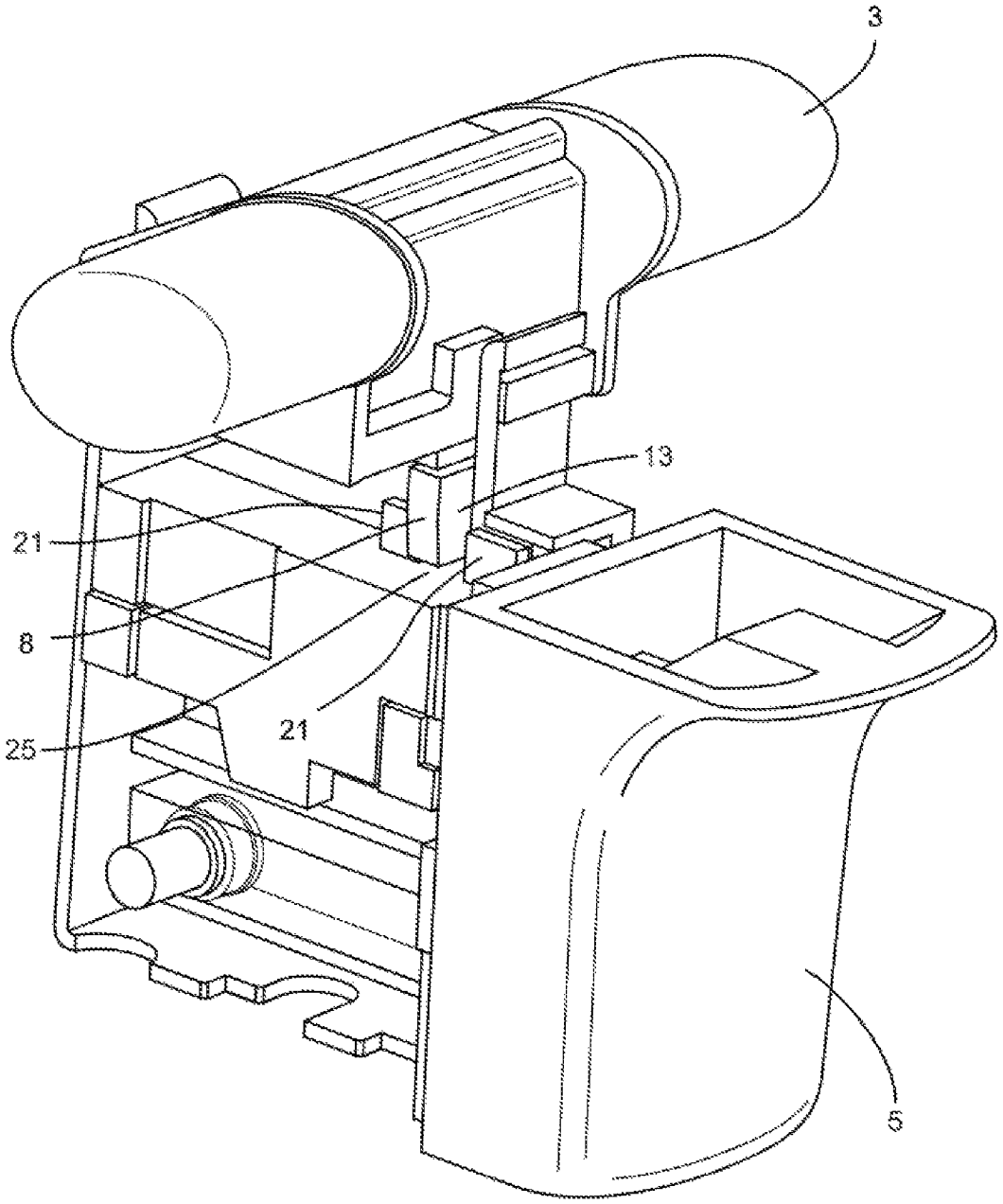
FIG. 9 depicts a detailed view of the second embodiment of the trigger and locking button showing the detents or pins on the trigger and locking button in a lock ON position.

The release/lock button 3 must be moved laterally to move the lock pin 8 out of the path of movement of the trigger pin 21 so the trigger can be moved toward an ON position as depicted in FIG. 8. The release/lock button 3 is biased toward the blocking position by springs 26. The locked-on functionality is provided by a gap or slot 25 located in front of the trigger pin 21 that provides clearance for the release/lock button to return to the blocking position as depicted in FIG. 9. In this position, movement of the lock pin 8 is prevented both toward and away from the switch 1 so the trigger 5 can be retained in an ON position. Although not depicted, multiple slots or gaps may be provided may be arrayed in front of the trigger pin to allow the trigger to be locked in multiple ON positions. This configuration would be useful in tools having a variable speed trigger switch to provide multiple speeds of operation into which the trigger can be locked.

While the disclosure has been illustrated and described in detail in the drawings and foregoing description, the same should be considered as illustrative and not restrictive in character. It is understood that only the preferred embodiments have been presented and that all changes, modifications and further applications that come within the spirit of the disclosure are desired to be protected.

What is claimed is:

1. A power tool comprising:

a housing;

a motor enclosed within the housing;

a work element configured to be driven by the motor;

a trigger movably secured to the housing, the trigger being configured to be moved to an ON position at which power is supplied to the motor and to an OFF position at which power is disconnected from the motor; and a locking assembly supported by the housing and including a lock-OFF mechanism configured to lock the trigger in the OFF position and a lock-ON mechanism configured to lock the trigger in the ON position, wherein, when the trigger is not locked in the OFF position or the ON position, the trigger is in an unlocked mode in which the trigger is allowed to move between the OFF and ON positions, wherein the trigger is configured to move between an extended position and a depressed position, the extended position corresponding to the OFF position, the depressed position corresponding to the ON position, wherein the lock-OFF mechanism is configured to releasably lock the trigger in the extended position, wherein the lock-ON mechanism is configured to releasably lock the trigger in the depressed position, wherein the lock-OFF mechanism is movably supported by the housing for movement between a blocking position and a non-blocking position with respect to the trigger, wherein the lock-OFF mechanism includes a lock-OFF structure such that when the trigger is in the OFF position and the lock-OFF mechanism is in the non-blocking position, the lock-OFF structure is positioned to allow the trigger to move between the OFF and ON positions, and, when the trigger is in the OFF position and the lock-OFF mechanism is in the blocking position, the lock-OFF structure is positioned to block movement of the trigger from the OFF position, wherein the lock-OFF mechanism includes at least one actuator that is accessible from an exterior of the housing and configured to move the lock-OFF mechanism between the blocking position and the non-blocking position, wherein the lock-OFF mechanism is laterally slidable with respect to the housing and the trigger between the blocking and non-blocking positions, wherein at least one actuator includes a first actuator located at a first lateral end of the locking mechanism for moving the locking mechanism from the blocking position to the non-blocking position and a second actuator located at a second lateral end of the locking mechanism for moving the locking mechanism from the non-blocking position to the blocking position, wherein the lock-ON mechanism is movably supported by the housing for movement between a blocking position and a non-blocking position with respect to the trigger, wherein the lock-ON mechanism includes a lock-ON structure such that when the trigger is in the ON position and the lock-ON mechanism is in the non-blocking position, the lock-ON structure is positioned to allow the trigger to move between the OFF and ON positions, and, when the trigger is in the ON position and the lock-ON mechanism is in the blocking position, the lock-ON structure is positioned to block movement of the trigger from the ON position, wherein the lock-ON mechanism includes a push button that is accessible from an exterior of the housing and configured to move the lock-ON mechanism from the non-blocking position to the blocking position, wherein the lock-ON mechanism comprises a pin that is supported for axial movement between the blocking and non-blocking positions, the pin including an inner end arranged facing the trigger and an outer end that is accessible from an exterior of the housing, wherein the inner end of the pin comprises the lock-ON structure, wherein the outer end of the pin comprises the push button, wherein the pin is biased toward the non-blocking position, wherein the trigger includes a plurality of walls that define a recess in which the inner end of the pin is received when the pin is moved to the blocking position, wherein the plurality of walls include a ramped surface that is configured to move into contact with the inner end of the pin when the trigger is moved from the ON position toward the OFF position, and wherein contact between the ramped wall and the inner end of the pin is configured to cause the pin to move from the blocking position to the non-blocking position.

2. A trigger assembly for a power tool comprising:

a trigger movably configured to be movably secured to a housing of a power tool, the trigger being configured to be moved to an ON position at which power is supplied to the power tool and to an OFF position at which power is disconnected from the power tool; and a locking assembly configured to be supported by the housing and including a lock-OFF mechanism configured to lock the trigger in the OFF position and a lock-ON mechanism configured to lock the trigger in the ON position, wherein the trigger is not locked in the OFF position or the ON position, the trigger is in an unlocked mode in which the trigger is allowed to move between the OFF and ON positions, wherein the lock-OFF mechanism is movably supported by the housing for movement between a blocking position and a non-blocking position with respect to the trigger, wherein the lock-OFF mechanism includes a lock-OFF structure such that when the trigger is in the OFF position and the lock-OFF mechanism is in the non-blocking position, the lock-OFF structure is positioned to allow the trigger to move between the OFF and ON positions, and, when the trigger is in the OFF position and the lock-OFF mechanism is in the blocking position, the lock-OFF structure is positioned to block movement of the trigger from the OFF position, wherein the lock-ON mechanism is movably supported by the housing for movement between a blocking position and a non-blocking position with respect to the trigger, wherein the lock-ON mechanism includes a lock-ON structure such that when the trigger is in the ON position and the lock-ON mechanism is in the non-blocking position, the lock-ON structure is positioned to allow the trigger to move between the OFF and ON positions, and, when the trigger is in the ON position and the lock-ON mechanism is in the blocking position, the lock-ON structure is positioned to block movement of the trigger from the ON position, wherein the lock-OFF mechanism is laterally slidable with respect to the housing and the trigger between the blocking and non-blocking positions, wherein a first actuator is located at a first lateral end of the locking mechanism for moving the locking mechanism from the blocking position to the non-blocking position and a second actuator is located at a second lateral end of the locking mechanism for moving the locking mechanism from the non-blocking position to the blocking position, wherein the lock-ON mechanism comprises a pin that is supported for axial movement between the blocking and non-blocking positions, the pin including an inner end arranged facing the trigger and an outer end that is accessible from an exterior of the housing, wherein the inner end of the pin comprises the lock-ON structure, and wherein the outer end of the pin comprises the push button, wherein the trigger includes a plurality of walls that define a recess in which the inner end of the pin is received when the pin is moved to the blocking position, wherein the plurality of walls include a ramped surface that is configured to move into contact with the inner end of the pin when the trigger is moved from the ON position toward the OFF position, and wherein contact between the ramped wall and the inner end of the pin is configured to cause the pin to move from the blocking position to the non-blocking position.

* * * * *